United States Patent [19]

Price

[11] 4,227,582

[45] Oct. 14, 1980

[54] WELL PERFORATING APPARATUS AND METHOD

[76] Inventor: Ernest H. Price, 1266 Pepper Dr., El Centro, Calif. 92243

[21] Appl. No.: 84,355

[22] Filed: Oct. 12, 1979

[51] Int. Cl.[3] ..... E21B 7/15; E21B 29/02; E21B 43/11

[52] U.S. Cl. ..... 175/16; 166/55; 166/297; 175/12; 175/13

[58] Field of Search ..... 175/12, 11, 13, 14, 175/16, 24; 166/297, 55, 57; 299/14; 219/121 L, 121 LM

[56] References Cited

U.S. PATENT DOCUMENTS

| | | | |
|---|---|---|---|
| 3,461,964 | 8/1969 | Venghiattis | 166/297 |
| 3,539,221 | 11/1970 | Gladstone | 299/14 |
| 3,556,600 | 1/1971 | Shoupp et al. | 175/16 X |
| 3,788,703 | 1/1974 | Thorpe | 175/16 X |
| 3,912,013 | 10/1975 | Vann | 166/297 |
| 3,998,281 | 12/1976 | Salisbury et al. | 175/16 |
| 4,066,138 | 1/1978 | Salisbury et al. | 175/16 |
| 4,090,572 | 5/1978 | Welch | 175/16 |

*Primary Examiner*—Stephen J. Novosad
*Attorney, Agent, or Firm*—Dennis T. Griggs

[57] ABSTRACT

A method and apparatus for perforating a well casing and surrounding formation are disclosed. The perforating apparatus includes a laser source for projecting a high intensity laser beam transversely through the well bore and surrounding formation and a nozzle assembly for injecting exothermically reactive gas along the path of the laser beam. The gas stream shields the output lens of the laser while accelerating the rate of laser beam penetration. The laser beam is actuated as the exothermic gas is discharged through the nozzle during a penetrating cycle, and the laser beam is interrupted while the exothermic gas is discharged during a melt ejection cycle following the penetrating cycle. When the laser tool is used for perforating materials such as concrete, stone and sand which do not react exothermically with the gas, a fluxing agent is discharged into the flow path of the nozzle and is entrained by the exothermically reactive gas during the penetrating cycle.

11 Claims, 5 Drawing Figures

WELL PERFORATING APPARATUS AND METHOD

BACKGROUND OF THE INVENTION

1. Field of the Invention

This invention relates generally to well completion methods and apparatus, and in particular to improved methods and apparatus for perforating formations surrounding a well bore.

2. Description of the Prior Art

According to conventional well completion procedures, after a productive strata has been reached during the drilling of an oil or gas well, a well casing is run into the bore hole and is set in place by injecting a volume of cementitious material such as concrete into the annulus between the bore hole wall and casing wall. The annular layer of concrete anchors the well casing in place and seals the productive zone to prevent migration of formation fluids from one zone to another through the annular space. However, the annular volume of cement and the well casing block the flow of formation fluid into the interior of the casing. Therefore the concrete layer and the well casing must be perforated to permit the production of formation fluids to the surface.

In addition to perforating the well casing and cement material, it is sometimes desirable to perforate the surrounding formation in order to increase its permeability and enhance the flow of formation fluid to or from the formation. It is well known that many formations exist which contain large reserves of oil which cannot be recovered at a profitable rate due to the relatively low permeability of the formation or for other reasons. Attempts have been made to increase the production rate by fracturing the formation by the application of fluid pressure to develop cracks or fractures, and while such procedures have in many cases increased production, there are instances wherein the fracturing procedure has caused the loss of the well. One of the difficulties encountered with the formation fracturing methods is caused by the annular cement layer. According to conventional fracturing techniques, after a casing has been landed, and cement has been set between the bore hole wall and casing, the casing is punctured by a mechanical means such as a bullet or a shaped charge. Thereafter, a fracturing fluid is dicharged through the punctured casing to cause the formation to fracture. This also tends to rupture the bond between the cement and the bore hole wall. The fracturing fluid will take the path of least resistance and flow upwardly or downwardly along the cement interface rather than out into the formation.

When completing a well by shooting the casing with a bullet or a shaped charge, the bore hole will sometimes be considerably enlarged because of sloughing off of the formation, cave-ins and the like. When the casing is cemented in place, there exists a considerable lateral thickness of cement between the casing and formation which in some cases cannot be penetrated by conventional bullet or shaped charge explosives.

Because of the potential recovery from large reserves in a formation having a relatively low permeability, attempts have been made to increase the productivity of such wells by forming a channel from the bore hole laterally out into the formation. According to one technique, a whip stock is set in the casing and then after a mill has cut a window in the casing, a bit is run in on a flexible drill string and a hole is drilled out by rotating the bit into the formation. Although these procedures have been reasonably effective in forming the formation channels, the channels are usually so large as compared to the grain size of the formation sand to permit migration of the sand along with the formation fluids into the interior of the casing, thereby causing serious damage or destruction of equipment operating within the casing.

Although preperforated or slotted liners and screens can be run as part of the casing into the well bore and positioned adjacent the sand formation, it is sometimes desirable to be able to carry out completion operations at a different zone after the casing has been set. In such cases, it would be useful to be able to perforate the well casing adjacent a different production zone without removing it from the well bore.

Although quantum devices such as laser have been used for drilling holes in metal, their usage for perforating a well casing and the surrounding formation in situ has been believed to be impractical because of adverse conditions in the downhole environment. However, because the laser is capable of precise control for drilling relatively small channels through the well casing and surrounding formation without rupture, it seems to be otherwise well suited for well completion operations. There is, therefore, a continuing interest in adapting quantum devices such as lasers for use in downhole environments for carrying out well perforation and other completion operations.

SUMMARY OF OBJECTS OF THE INVENTION

It is, therefore, the principal object of the invention to provide an improved laser perforating apparatus which is adapted for use in a downhole environment for perforating a well casing and the surrounding formation.

A related object of the invention is the provision of a laser perforating apparatus for use in a well bore which is capable of penetrating not only the well casing but also the surrounding formation which may include material such as concrete, stone and unconsolidated material such as sand.

Another object of the invention is to provide an improved method for operating a laser perforating apparatus in combination with an exothermic gas for accelerating the rate of penetration of the laser beam and for automatically ejecting melt from the laser penetration site.

Still another object of the invention is to provide a downhole laser tool which employs a high pressure exothermic gas for accelerating the rate of penetration of a laser beam emitted through the output lens while shielding the output lens of a laser source with respect to adverse downhole environment conditions.

One further object of the invention is the provision of a nozzle and protective shroud assembly for attachment to a laser tool which cooperates with a high pressure gas stream for shielding sensitive components of the laser with respect to adverse downhole conditions and which produces a back flow of the shielding gas which deflects melt and reaction gases as they are ejected and vents the gases away from sensitive components of the laser tool.

SUMMARY OF THE INVENTION

According to novel features of the present invention, the foregoing objects are achieved by a well perforating apparatus which includes a laser source and a nozzle assembly for injecting exothermically reactive gas along the laser discharge path. The gas stream shields the output lens of the laser while accelerating the rate of laser beam penetration. A shroud is coupled to the laser housing and encloses the nozzle. The nozzle is characterized by a tapered sidewall which converges towards the laser discharge opening in the shroud, and the shroud is provided with a tapered bore carried in spaced relation with the tapered sidewall thereby defining an annular vent chamber.

According to a preferred method of the invention, the laser beam is actuated as the exothermic gas is discharged through the nozzle during a penetrating cycle, and the laser beam is interrupted while the exothermic gas is discharged during a melt ejection cycle following the penetrating cycle. When the laser tool is used for perforating material such as concrete, stone and sand which do not react exothermically with the gas, a fluxing agent is discharged into the flow path of the nozzle and is extrained by the exothermically reactive gas during the penetrating cycle.

According to a preferred method for operating the laser tool, the exothermic gas is discharged at a relatively high flow rate during the penetrating and ejection cycles, and is discharged at a relatively low flow rate during a venting interval following a penetrating cycle. The output lens of the laser tool is shielded with respect to the back flow of the reaction gases by the continuous discharge of the exothermic gas at the relatively low flow rate, and by the provision of a protective shroud forming an annular vent chamber surrounding the discharge end of the nozzle whereby vent gases are deflected away from the nozzle discharge opening and through vent discharge ports into the well bore.

The foregoing and other related objects and advantages of the present invention will become more apparent from the following specification, claims and appended drawings wherein:

DESCRIPTION OF THE PREFERRED EMBODIMENT

Figure 1:
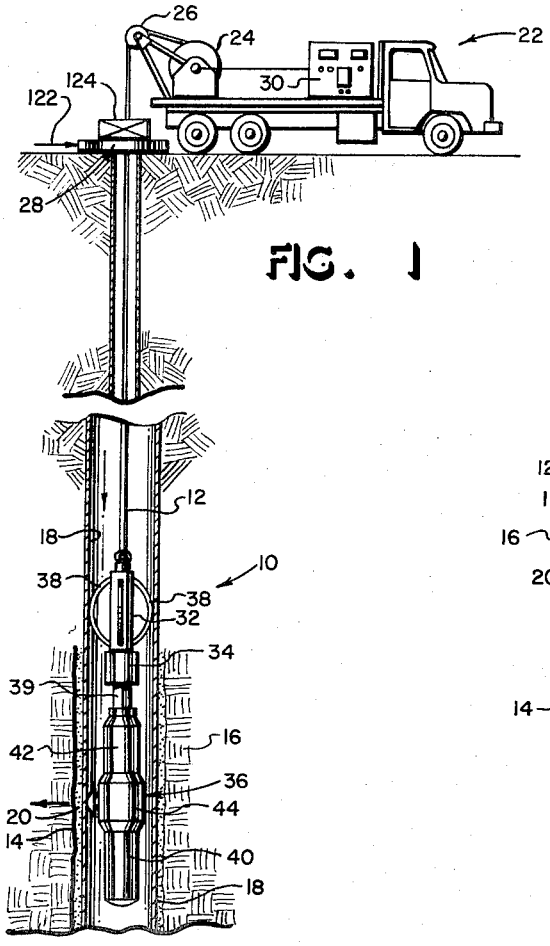
FIG. 1 is a vertical, sectional view of a well bore extending through a production zone and in which a well perforating tool constructed according to the teachings of the invention is suspended.

In the description which follows, like parts are marked throughout the specification and drawings with the same reference numerals, respectively. The figures are not necessarily drawn to scale and in some instances portions have been exaggerated in order to more clearly depict certain features of the invention.

Referring now to FIG. 1 of the drawings, there is illustrated a well perforating tool 10 which is suspended by an armored cable 12 within a bore hole 14 traversing a subterranean production zone of interest indicated by the reference numeral 16. The armored cable 12 encloses a bundle of power conductors for transmitting electrical power and control signals to the well perforating apparatus 10. The well bore 14 is drilled by conventional techniques and is fitted with a production casing 18 which is cemented in place by an annular layer of concrete 20 which is pumped under pressure between the well bore and the well casing. After the casing 18 has been cemented in place, the well is completed by perforating the well casing and cement layer at a number of elevations along the subterranean formation 16 to permit formation fluid to enter the interior of the casing 18 and be produced to the surface.

While reference is made herein to "completion" of a well, it will be understood that this term is used in its broadest sense to include not only the preparation of the well for flowing of production fluid from the formation into the well casing, but also to include preparing a well as a water flooding well or one to be employed in other secondary recovery operations such as disposal. The term is also applicable to both newly drilled wells and to wells which have been previously completed. Thus, the invention relates broadly, insofar as its end use is concerned, to preparing wells for production or for use in secondary recovery operations wherein it is desired to establish a lateral flow way between a formation and a bore hole to permit ready flow of fluids to or from the surrounding formation.

A mobile rig 22 is used for raising and lowering the well perforating apparatus 10 through the well casing 18. The armored cable 12 is played out from a spool 24 and around a sheave 26 as is well known in the art. The mobile rig 22 is parked adjacent to a conventional well head assembly 28 with the sheave 26 aligned with the bore hole axis. The well perforating assembly 10 is raised and lowered through the well casing 18 as the armored cable 12 is played out and retrieved by the mobile rig 22. When the perforating assembly 10 has reached a desired elevation within the well casing 18, appropriate switches on a control panel 30 are actuated to energize the laser tool within the well perforating assembly 10. This portable rig and cable system enables perforations or cross holes to be formed quickly in the well casing at different elevations along the production zone 16.

The well perforating assembly includes as major components a centralizer assembly 32, a motor 34 and a tubular laser housing 36. The centralizer assembly 32 includes three or more bow springs 38 for sliding engagement with the interior wall of the well casing 18. The purpose of the bow springs 38 is to hold the tubular laser housing 36 centered within the well casing 18 while permitting free vertical displacement of the perforating assembly through the well casing. The bow springs 38 also serve to prevent the application of torque to the armored cable 12 when the motor 34 is rotating the tubular laser housing 36.

The purpose of the motor 34 is to rotate the tubular laser housing 36 so that the direction of the laser tool can be varied in azimuth through at least 360°. The motor 34 includes a rotor coupling section 39 which is directly attached to the upper end of the tubular laser housing 36. The motor 34 is actuated through the control panel 30 by electrical signals transmitted through the armored cable 12.

Figure 2:
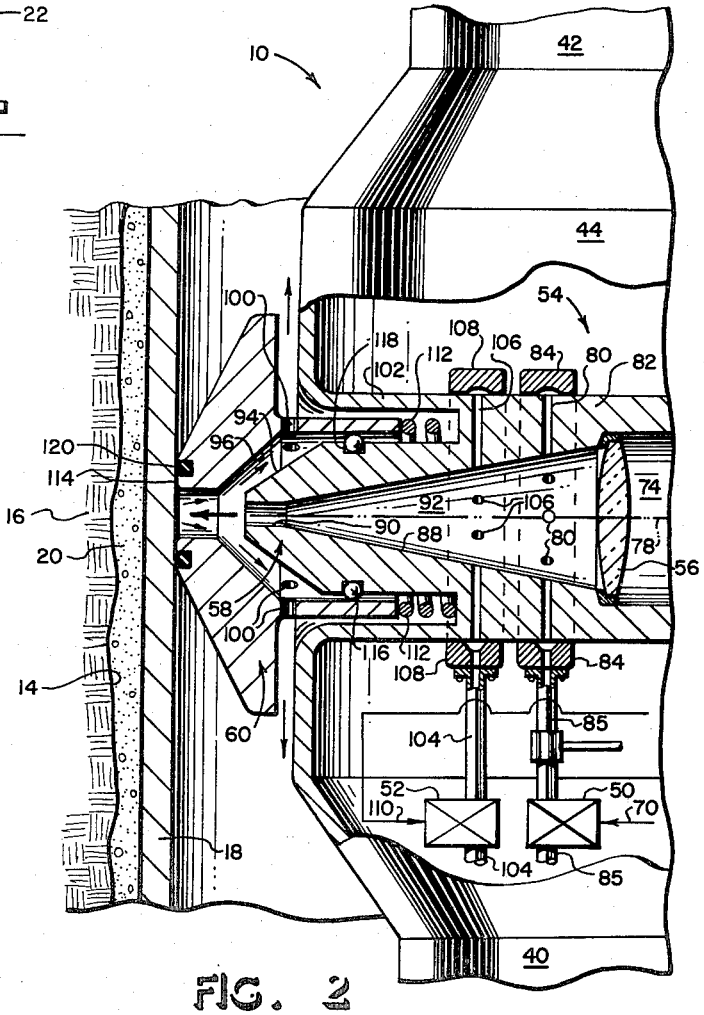
FIG. 2 is a sectional view of a portion of the well perforating tool shown in FIG. 1 which illustrates the nozzle and shroud details of the invention.
Figure 3:
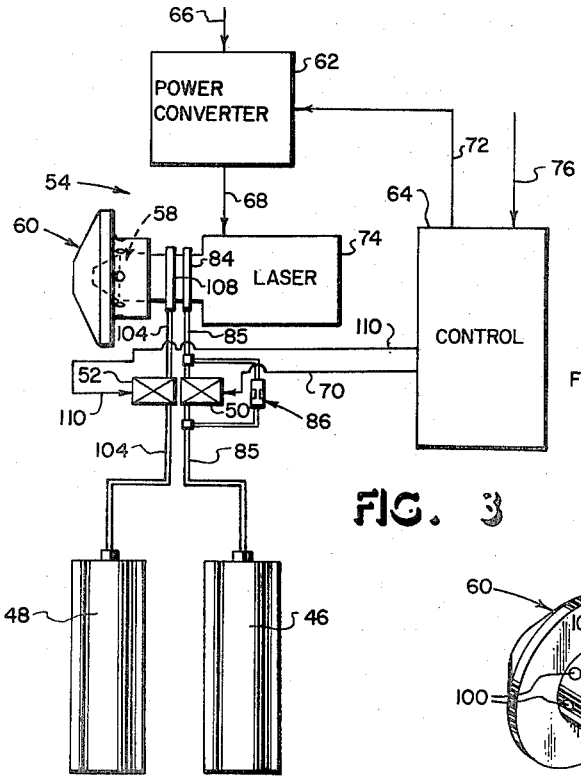
FIG. 3 is a schematic view which illustrates the interconnection of the principal components of the well perforating apparatus shown in FIG. 1.

Referring now to FIGS. 1, 2 and 3, the tubular laser housing is organized into a lower tubular section 40, an upper tubular section 42 and a midsection 44. Contained within the lower tubular section 40 are a pair of pressurized containers 46, 48 which contain, respectively, an exothermic gas such as oxygen, and a fluxing agent. Also enclosed within the lower tubular section 40 are first and second fluid control valves 50, 52 for opening and closing a flow path between the pressurized containers 46, 48 and the laser tool, respectively.

Enclosed within the midsection 44 is a laser tool 54 which includes an output lens 56, a nozzle 58 coupled in sealed engagement with the output lens and a shroud 60 coupled to the nozzle 58. The following currently available lasers are preferred for use in this application: (a) a hydrofluorine chemically driven laser operating at 2.6 microns wavelength; (b) a $CO_2$ laser operating at 10.6 microns wavelength; and, (c) solid state lasers such as Neodymium glass operating at 1.06 microns. However, other laser systems, including lasers of advanced design which become available in the future, may be used to good advantage. It is contemplated that all operation characteristics of the system such as pulse length, frequency, area and diameter of the annular area contacted, power input and operating wavelength of the source of coherent light are subject to continuous variation and control depending upon such factors as the physical properties of the well casing material or formation strata being penetrated.

The upper tubular section 42 encloses a power converter 62 and a control unit 64. The power converter 62 receives electrical power 66 conducted through the armored cable assembly 12 and converts it to the proper voltage and current levels as represented symbolically by the arrow 68 in FIG. 3. The exact power requirements will depend upon the type of laser utilized.

The purpose of the control unit 64 is to supply actuating signals 70, 72 for coordinating the operation of the controllable valves 50, 52 and the actuation of the laser assembly 54. To carry out these functions, the control unit 64 is programmed to generate two control signals 70, 72, with the control signal 70 being coupled to the $O_2$ solenoid control valve 50, and the control signal 72 being coupled to the fluxing agent solenoid controlled valve 52 and to the power converter 62 as shown in FIG. 3. The laser assembly preferably includes a cascaded laser source 74 of the type designated above, and is enclosed vertically within the upper tubular section 42.

Figure 5:
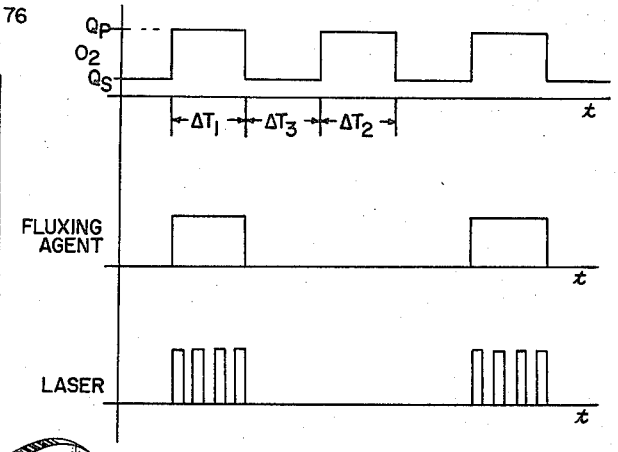

According to the arrangement described above, the control unit 64 is actuated through a control signal 76 transmitted through the armored cable 12 for initiating the perforating operation. According to a preferred method of operating the laser assembly, the generation of a laser beam by the cascaded laser source 74 and the delivery of the exothermic gas is coordinated by the control unit 64 so that the exothermic gas is discharged while the laser beam is actuated during a penetrating cycle, and the laser beam is inhibited while the exothermic gas is discharged during an ejection cycle following the penetrating cycle as shown in FIG. 5.

The use of the exothermic gas produces an exothermic reaction which accelerates the rate of penetration. A jet of the exothermic gas is delivered during the ejection cycle to drive out liquified metal to prevent the perforated region from collapsing and closing up on itself. The penetration cycle is indicated graphically by the interval $\Delta T_1$, and the ejection cycle is indicated graphically by the interval $\Delta T_2$ as shown in FIG. 5. A venting interval is identified by $\Delta T_3$ during which time gaseous reaction products are vented through the shroud 60 as will be explained below.

Although conventional well casing materials can be penetrated easily by the combination of the exothermic gas and laser beam, there are some materials for which a fluxing agent is useful. For example, the cement material surrounding the well casing and the surrounding formation, which may include rock formations and sand, do not react exothermically with oxygen. To penetrate these materials with a laser beam it is necessary to introduce a metal or compound which permits an exothermic reaction with the gas and creates a fluxing action with the material to be penetrated at the point where the laser beam strikes the material. The gas jet then sweeps the reaction products away from the penetration area during the ejection cycle. As an example, the fluxing agent may be fed in powdered form in the form of a gas jet as shown in FIG. 3 of the drawing. Additionally, the fluxing agent may be powdered iron or halides of the alkali metals. In any case, the fluxing agent is fed into the laser system downstream relative to the point of introduction of the exothermic gas.

Figure 4:
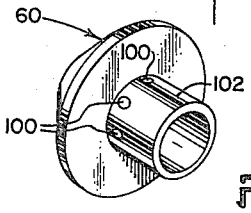
FIG. 4 is a perspective view of the protective shroud shown in FIG. 2; and, FIG. 5 is a graphical illustration which represents a preferred method for operating the laser tool shown in FIG. 3.

Referring now to FIGS. 2 and 4, the laser source 74 when actuated projects a high intensity, coherent laser beam transversely through the well bore along the laser discharge path as indicated by the line 78. Because of the likelihood of unfavorable downhole conditions, it is desirable to shield the output lens 56. According to a preferred arrangement of the invention, the shielding function is provided by the exothermic gas stream as it is discharged through the nozzle 58. In the arrangement shown in FIG. 2, the exothermic gas, oxygen, is introduced into the laser discharge path within the nozzle through a set of gas inlet openings 80 which communicate with the interior of the nozzle downstream of the output lens 56. The $O_2$ gas inlet openings 80 extend completely through the nozzle housing 82 where they are connected in common fluid communication with a manifold 84 which encircles the nozzle housing. The manifold 84 is connected in fluid communication with the pressurized $O_2$ container 46 through the solenoid controlled valve 50 and a gas inlet conductor 84.

Referring now to FIGS. 3 and 5, a predetermined flow of oxygen is discharged through the nozzle continuously by means of a flow restrictor 86 which is connected in parallel with the $O_2$ control valve 50. The flow restrictor 86 continuously delivers a predetermined flow rate $Q_S$ of oxygen through the nozzle whereby the nozzle is pressurized and the output lens 56 is shielded at all times during perforating operations. The presence of the controlled flow of oxygen is especially important during the venting cycle as gaseous reaction products are conveyed by reverse flow into the interior of the shroud 60.

According to a preferred construction, the nozzle 58 is provided with a conical bore formed by a tapered sidewall 88 which converges toward the laser discharge opening 89 in the shroud. Near the tip of the nozzle, the conical bore transitions into a venturi region formed by a cylindrical bore 90. This converging bore/venturi bore combination produces very high pressure, supersonic flow for a discharge pressure of a few bars. The supersonic jet of exothermic gas emerging from the nozzle in combination with the laser beam greatly accelerates the rate of penetration, and is especially useful for driving out melt and reaction products during the ejection cycle.

As previously discussed, it is desirable to shield the lens 56 with respect to the reaction products. The continuous delivery of oxygen at the flow rate $Q_S$ prevents the entry of reaction products into the nozzle chamber 92 during the venting cycle. Additionally, the nozzle is provided with an external tapered sidewall surface 94 which converges toward the laser discharge opening in the shroud, and the shroud 60 is provided with a tapered bore 96 which is carried in spaced relation with respect to the tapered sidewall 94 thereby defining an annular vent chamber 98 through which the gaseous reaction products are conveyed during the vent cycle. The gaseous reaction products are discharged out of the vent chamber 98 through a set of vent openings 100 which are formed through the sidewall 102 of the shroud. Although the initial path of the gaseous reaction products is directly toward the venturi bore 90 which forms the outlet of the nozzle 58, the presence of the oppositely directed flow $Q_S$ in combination with the Coanda fluidic effect, causes the reverse flow to travel through the annular vent chamber 98 along the tapered bore 96 for discharge through the vent openings 100 instead of into the nozzle bore 90.

When the laser tool 74 is used for perforating material such as concrete, stone and sand which do not react exothermically with oxygen, a fluxing agent is discharged into the flow path of the nozzle and is entrained by the exothermically reactive gas during the penetrating cycle. The fluxing agent is conveyed from the pressurized container 48 through a fluid conductor 104 and through the solenoid controlled valve 52 for discharge through a second set of gas inlet openings 106 which extend through the nozzle housing 82 to the nozzle interior 92 at a location downstream with respect to the first set of gas inlet openings 82. The gas inlet openings 106 are connected in common fluid communication with a manifold 108. Because the flux gas inlet openings 106 are located downstream with respect to the exothermic gas openings 80, and because a predetermined flow rate $Q_S$ of exothermic gas is continuously delivered through those openings, the laser output lens 56 is shielded against contact by the fluxing agent.

Referring now to FIGS. 2 and 5, the exothermic gas is discharged at a relatively high flow rate $Q_P$ during the penetrating and ejection cycles $\Delta T_1$, $\Delta T_2$, respectively, and is discharged at the relatively low flow rate $Q_S$ during the venting interval $\Delta T_3$ following the penetrating cycle. The fluxing agent is delivered only during the penetrating cycle in response to a control signal 110. The application of laser power is shown to be pulsed during the penetration cycle; however, it may be delivered continuously during the penetrating cycle if desired.

The primary function of the protective shroud assembly 60 is to cooperate with the high pressure gas stream for shielding the laser output lens 56 with respect to adverse downhole conditions. The diverging, tapered sidewall configuration produces a back flow of the shielding gas which deflects the melt and gaseous reaction products as they are ejected from the penetration region and vents the gaseous products into the well bore. A further function of the shroud 60 is to maintain the discharge end of the nozzle assembly 58 disposed at a predetermined distance from the well casing 18. This function is carried out by means of a helical compression spring 112 which resiliently couples the shroud 60 to the nozzle housing 82. The spring 112 urges the nozzle face 114 into engagement with the well casing 18. The compression spring 112 is characterized by a restoring force which under equilibrium conditions maintains the face of the shroud against the sidewall of the well casing when the longitudinal axis of the tubular laser housing 36 is substantially in alignment with the longitudinal axis of the well casing 18. The tubular sidewall 102 of the shroud 60 is supported by a set of roller ball bearings 116 which are confined within a race 118 machined within the nozzle housing 82. According to this arrangement, the shroud 60 slides very freely and without friction as the tubular laser housing 36 is displaced upwardly and downwardly and as it is rotated in azimuth. An O-ring seal 120 having a low coefficient of friction and suitable for high temperature operation is carried on the face 114 of the shroud for engaging the well casing 18.

It may be desirable under certain conditions to pressurize the well casing with a non-flammable gas, such as nitrogen, or helium, in order to minimize the risk of an explosion which might otherwise occur within accumulation of vented oxygen around the laser assembly. The flow of non-flammable gas into the well casing is represented by the arrow 122 which is connected to a valve and seal assembly which form a part of the well head equipment 28 as shown in FIG. 1.

Because the laser tool assembly 54 is capable of forming relatively small perforations as compared with the perforations produced by an explosive charge or a lance, a foraminous well screen can be produced which has excellent sand control characteristics and which can be formed without introducing unwanted longitudinally extending flow paths between the annular cement layer 20 and the well casing 18. Additionally, the surrounding formation can be penetrated to form drainage channels leading to the foraminous screen.

It will be apparent that the invention may be embodied in other specific forms without departing from the spirit or essential characteristics thereof. Thus the present embodiment should therefore be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by U.S. Letters Patent is:

1. Well bore perforating apparatus comprising:

a tubular housing for traversing the well bore;

a laser beam source including an output lens mounted within said housing for directing a laser beam toward the well bore;

a fluid nozzle coupled to said tubular housing and having an outlet port through which the laser beam emerges toward the well bore;

a first set of gas discharge openings formed in the fluid nozzle means downstream of said output lens.

a pressurized source of exothermically reactive gas coupled to the gas discharge openings;

a controllable valve interposed in series fluid circuit relation between the pressurized source of exothermic gas and the gas discharge openings for selectively opening and closing a flow path therebetween;

a source of electrical power for energizing said laser beam source; and, control means coupled to said electrical power source, said controllable valve, and to said laser beam source for coordinating the operation of the controllable valve and the application of the laser beam.

2. The well bore perforating apparatus as defined in claim 1 including a flow restrictor connected in fluid parallel relation with said controllable valve for continuously delivering a quantity of the exothermic gas to the gas discharge openings at a reduced flow rate relative to the flow rate delivered through the controllable valve.

3. The well bore perforating apparatus as defined in claim 1, including:

a second set of gas discharge openings formed in the fluid nozzle downstream of the first set of gas discharge openings;

a pressurized source of fluxing agent which is exothermically reactive with the well bore material coupled to the second plurality of gas discharge openings;

a controllable valve interposed in series fluid circuit relation between the pressurized source of fluxing agent and the second set of gas discharge openings for selectively opening and closing a flow path therebetween, said controllable valve being responsively coupled to said control means whereby the fluxing agent is discharged through said nozzle during the penetrating cycle and is interrupted during the ejection cycle.

4. The well bore perforating apparatus as defined in claim 1, said fluid nozzle being mechanically coupled in axial alignment with the focal axis of said output lens and having a tapered bore which converges towards the nozzle outlet port downstream of the lens.

5. The well bore perforating apparatus as defined in claim 1, including a shroud coupled to said tubular housing and enclosing said nozzle, said shroud having a laser discharge opening aligned with the laser beam axis and nozzle opening through which the laser beam and gas emerge, and a vent port connecting the interior of said shroud in fluid communication with the interior of the well bore.

6. The well bore perforating apparatus as defined in claim 5, wherein said nozzle is characterized by a tapered sidewall which converges toward the laser discharge opening in said shroud, and said shroud having a tapered bore disposed in spaced relation with the tapered sidewall thereby defining an annular vent chamber.

7. The well bore perforating apparatus as defined in claim 5, said shroud being movably coupled to said tubular housing and including a compression spring interposed between said shroud and said nozzle for biasing said shroud toward said well bore.

8. A method for completing a well comprising the steps:

drilling a well bore through a formation;

positioning a well casing in the well bore adjacent said formation;

positioning a laser beam source in said casing adjacent said formation;

energizing said laser beam source and emitting a laser beam onto said casing during a penetrating cycle;

discharging a jet of pressurized gas which is exothermically reactive with the well casing material along the path of the laser beam and toward the well casing during the penetrating cycle;

interrupting the laser beam while discharging the exothermic gas into the region of penetration during an ejection cycle following the penetrating cycle.

9. The method as defined in claim 8 including the step:

discharging a jet of pressurized fluxing agent into the flow path of the exothermic gas during the penetrating cycle.

10. The method as defined in claim 8 including the step:

pressurizing said well casing with a gas which is nonflammable.

11. The method as defined in claim 8, wherein the exothermic gas is discharged at a relatively high flow rate during the penetrating and ejection cycles, and is discharged at a relatively low flow rate during a venting interval following a penetrating cycle.

* * * * *